US011835198B1

(12) United States Patent
Gauvin-Lamontagne

(10) Patent No.: US 11,835,198 B1
(45) Date of Patent: Dec. 5, 2023

(54) BLADE BOLLARD

(71) Applicant: LMPG Inc., Longueuil (CA)

(72) Inventor: Nicolas Gauvin-Lamontagne, Québec (CA)

(73) Assignee: LMPG INC., Longueuil (CA)

( * ) Notice: Subject to any disclaimer, the term of this patent is extended or adjusted under 35 U.S.C. 154(b) by 0 days.

(21) Appl. No.: 18/205,124

(22) Filed: Jun. 2, 2023

Related U.S. Application Data

(60) Provisional application No. 63/349,625, filed on Jun. 7, 2022.

(51) Int. Cl.
*F21S 8/08* (2006.01)
*F21V 21/10* (2006.01)

(52) U.S. Cl.
CPC ..... *F21S 8/083* (2013.01); *F21V 21/10* (2013.01)

(58) Field of Classification Search
CPC ..... F21S 8/083; F21V 21/10
See application file for complete search history.

(56) References Cited

U.S. PATENT DOCUMENTS 4,814,961 A * 3/1989 O'Brien ..... F21V 11/04 362/291
8,684,571 B1 * 4/2014 Alaura ..... E01F 9/685 362/431
2018/0313504 A1 * 11/2018 Eberts ..... F21V 15/015

* cited by examiner

*Primary Examiner* — Sean P Gramling
(74) *Attorney, Agent, or Firm* — Burns & Levinson, LLP; Joseph M. Maraia; Steven M. Mills

(57) ABSTRACT

A lighting apparatus includes an anchored base comprising a bollard configured to slide onto an anchor plate and a first extrusion configured to mate the bollard with the anchor plate at a bottom end of the bollard, a cap attachment comprising a second extrusion configured to mate with the bollard at a top end of the bollard, a fixture head comprising a third extrusion disposed on an LED optical chamber and a front cap, wherein the third extrusion is configured to mate with the front cap, and a first fixture head attachment disposed on an exterior surface of the bollard at a top end, wherein the first fixture head attachment includes a fourth extrusion configured to mate with the fixture head and operatively connect the fixture head with the anchored base, wherein the first, second, third, and fourth extrusions are configured to respectively mate at four regions of contact to flushly visually obscure one or more screws.

20 Claims, 16 Drawing Sheets

BLADE BOLLARD

CROSS-REFERENCE TO RELATED APPLICATIONS

The present application is related to and claims the benefit of U.S. Provisional Application No. 63/349,625, filed on Jun. 7, 2022, the entire contents of which are incorporated herein by reference.

BACKGROUND

1. Technical Field

The present disclosure is related to a lighting apparatus and, in particular, to a system and method for mating one or more extrusions with a lighting apparatus.

2. Discussion of Related Art

Light installations are often utilized in lighting, accenting, and/or decorating outdoor areas. To meet both the performance and aesthetic expectations of consumers, these lighting apparatuses must increasingly balance reliable and stylish considerations. Often, these apparatuses struggle to achieve this balance, and involve visible screws and/or other securing components to ensure respective regions of a lighting apparatus are both properly secured and functional.

SUMMARY

According to one aspect, a lighting apparatus is provided. The lighting apparatus includes an anchored base including a bollard configured to slide onto an anchor plate and a first extrusion configured to mate the bollard with the anchor plate at a bottom end of the bollard. The lighting apparatus includes a cap attachment including a second extrusion configured to mate with the bollard at a top end of the bollard. The lighting apparatus also includes a fixture head including a third extrusion disposed on an LED optical chamber and a front cap, wherein the third extrusion is configured to mate with the front cap. The lighting apparatus further includes a first fixture head attachment disposed on an exterior surface of the bollard at a top end, wherein the first fixture head attachment includes a fourth extrusion configured to mate with the fixture head and operatively connect the fixture head with the anchored base. Additionally, the first, second, third, and fourth extrusions are configured to respectively mate at four regions of contact to flushly visually obscure one or more screws.

In some exemplary embodiments, the anchor plate includes an anchoring system and an anchor bolt.

In some exemplary embodiments, the bollard is secured to the anchor plate with one or more locking screws.

In some exemplary embodiments, a locking screw secures the anchored base to a counterbore in the bollard.

In some exemplary embodiments, the first extrusion can be configured to link the anchored base more strongly to the bollard.

In some exemplary embodiments, the cap attachment is configured to operatively connect the fixture head with the anchored base.

In some exemplary embodiments, the cap attachment is secured by one or more screws. In some exemplary embodiments, the one or more screws are visually obscured by a head cover.

In some exemplary embodiments, the LED optical chamber is secured to the fourth extrusion by one or more screws. In some exemplary embodiments, the one or more screws are visually obscured by the front cap.

In some exemplary embodiments, the LED optical chamber is operatively connected to a drive assembly. In some exemplary embodiments, the drive assembly is operatively connected to a main body assembly disposed within the bollard.

In some exemplary embodiments, the first fixture head attachment is secured to the fourth extrusion by one or more screws. In some exemplary embodiments, the one or more screws are visually obscured by one or more counterboles. In some exemplary embodiments, the one or more screws is secured by one or more counterboles.

In some exemplary embodiments, the lighting apparatus includes a second fixture head attachment disposed on an exterior surface of the bollard at a top end and distally from the first fixture head attachment. In some exemplary embodiments, the second fixture head attachment includes a fifth extrusion configured to mate with the fixture head and operatively connect the fixture head with the anchored base. In some exemplary embodiments, the first, second, third, fourth, and fifth extrusions are configured to respectively mate at four points of contact to flushly visually obscure one or more screws.

In some exemplary embodiments, the one or more screws are held in position by one or more non-loadbearing counterboles.

According to another aspect, a method of mating a slide attachment is provided. The method includes joining to an anchored base, wherein the anchored base includes a bollard configured to slide onto an anchor plate and a first extrusion configured to mate the bollard with the anchor plate at a bottom end. The method includes joining a cap attachment, wherein the cap attachment includes a second extrusion configured to mate with the bollard at a top end. The method also includes joining a fixture head, wherein the fixture head includes a third extrusion disposed on an LED optical chamber and a front cap, wherein the third extrusion is configured to mate with the front cap. The method further includes joining a first fixture head attachment disposed on an exterior surface of the bollard at a top end, wherein the first fixture head attachment includes a fourth extrusion configured to mate with the fixture head and operatively connect the fixture head with the anchored base. Additionally, the first, second, third, and fourth extrusions are configured to respectively mate at four points of contact to flushly obscure one or more screws.

BRIEF DESCRIPTION OF THE DRAWINGS

The present disclosure is further described in the detailed description which follows, in reference to the noted plurality of drawings by way of non-limiting examples of embodiments of the present disclosure, in which like reference numerals represent similar parts throughout the several views of the drawings.

DETAILED DESCRIPTION

According to the system and method of the present disclosure, a lighting apparatus is provided. According to the technology of the disclosure, the lighting apparatus can include an anchored base. This anchored base can further include a bollard configured to slide onto an anchor plate and a first extrusion configured to mate the bollard with the anchor plate at a bottom end of the bollard.

According to embodiments of the present disclosure as described herein, the lighting apparatus can further include a cap attachment, which includes a second extrusion configured to mate with the bollard at a top end of the bollard. A fixture head, including a third extrusion disposed on an LED optical chamber and a front cap, can also be included. According to some implementations, the third extrusion is configured to mate with the front cap.

The light apparatus can also include a first fixture head attachment disposed on an exterior surface of the bollard at a top end. According to some implementations, the first fixture head attachment includes a fourth extrusion configured to mate with the fixture head and operatively connect the fixture head with the anchored base. In this way, the first, second, third, and fourth extrusions can be configured to respectively mate at four regions of contact to flushly visually obscure one or more screws.

Figure 1:
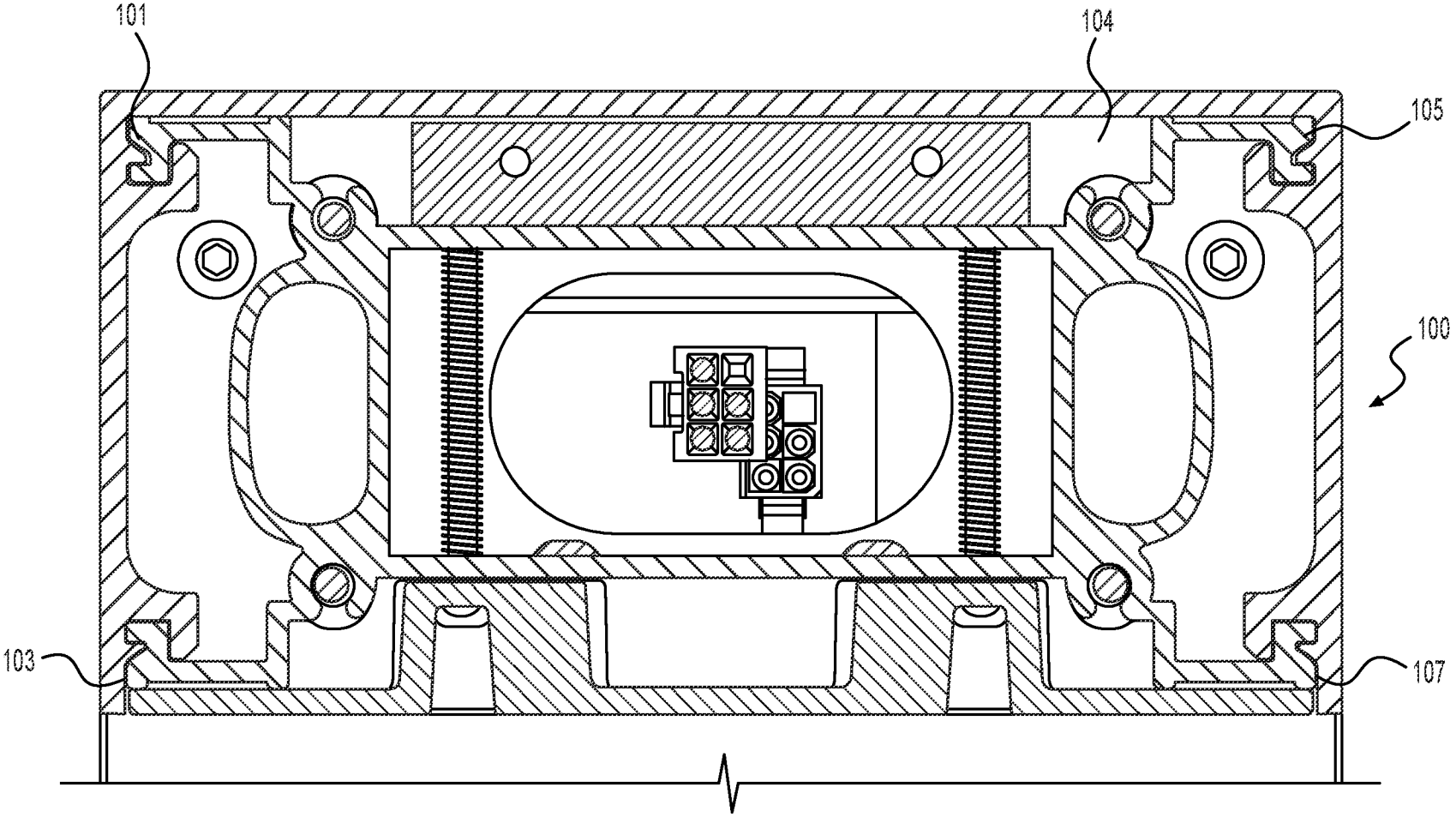
FIG. 1 is a perspective view of an extrusion as utilized in the lighting apparatus.

FIG. 1 shows view 100 of an extrusion 104 as utilized in the lighting apparatus 102. According to some implementations, extrusion 104 can slide to mate with at least four points of contact 101, 103, 105, and 107 respectively to mate with various components of lighting apparatus 102 (not pictured). Mating between various components can include applied embodiments of extrusion 104 in the context of lighting apparatus 102, such as first extrusion 106 configured to mate a bollard 108 with the anchor plate 110 at a bottom end 112 of the bollard 108, a second extrusion 114 including cap attachment 160 and configured to mate with the bollard 108 at a top end 116 of the bollard 108, a third extrusion 118 configured to mate with front cap 120, and a fourth extrusion 122 configured to mate with fixture head 124 and operatively connect the fixture head 124 with anchored base 126. This mating at four points of contact creates enough friction when combined with one or more locking screws to secure the various components of lighting apparatus 102 without being load-bearing as well. According to some implementations, the one or more locking screws 132 can be hidden in counterbore holes. For the purposes of the illustrative embodiments herein, one or more locking screws may also be referred to as simply one or more screws.

Figure 2A:
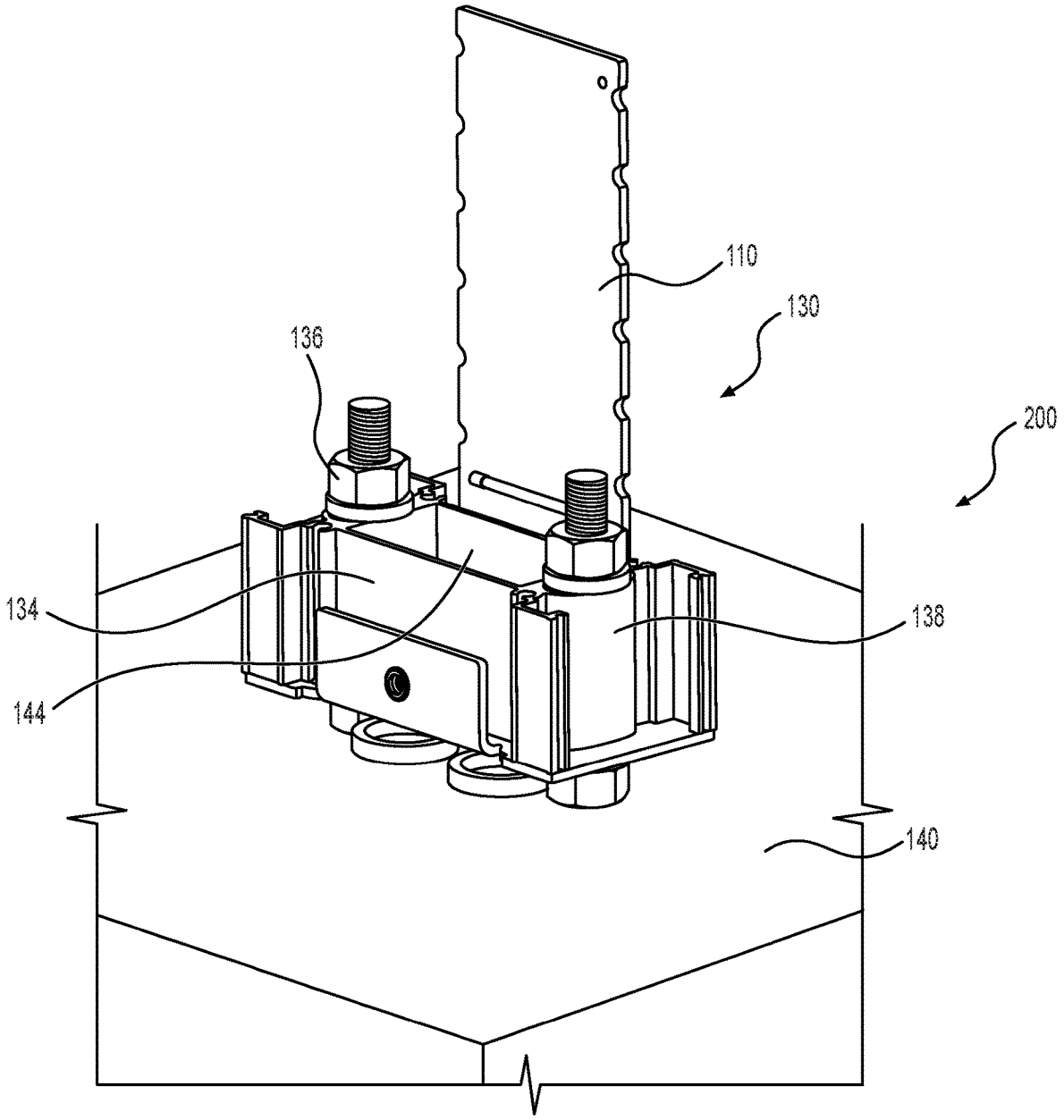
FIG. 2A is a perspective view of the installed anchored base.
Figure 2B:
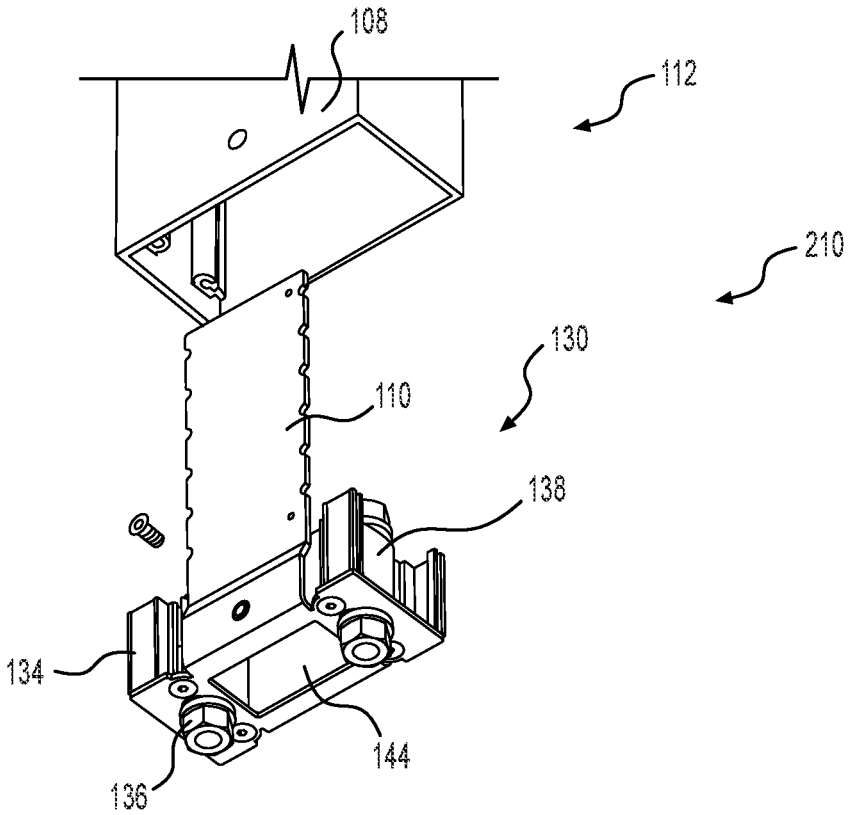
FIG. 2B is a perspective view of the bollard sliding onto the anchored base, and more specifically, the anchoring plate.
Figure 2C:
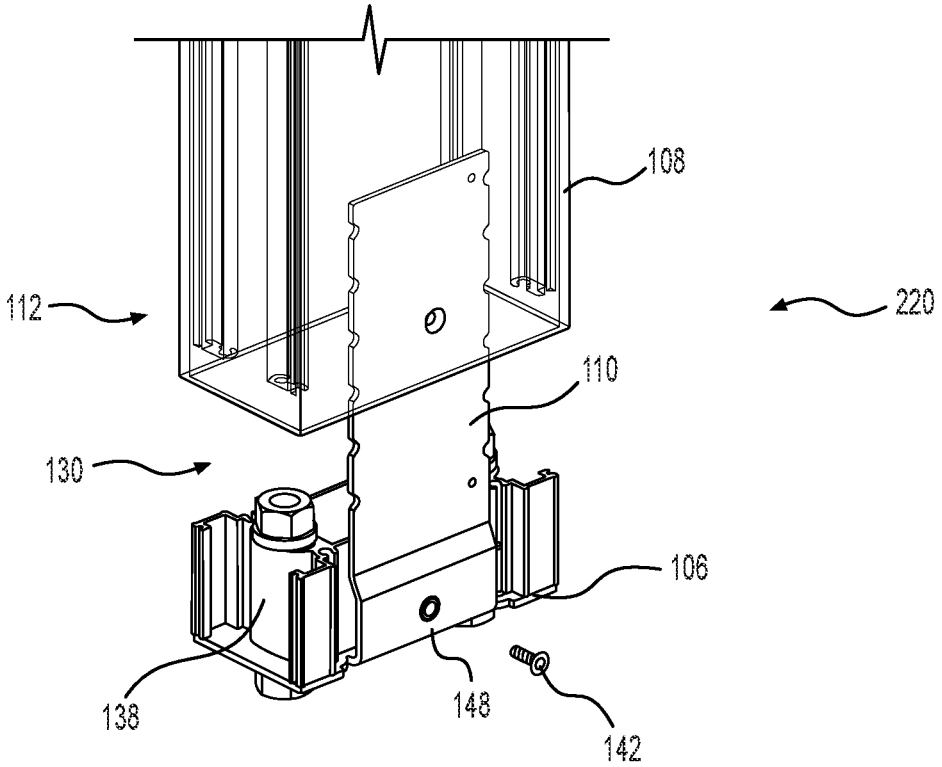
FIG. 2C is an additional perspective view of the bollard sliding onto the anchored base, highlighting the four points of contact within the bollard which can mate with the first extrusion within the anchoring system.

FIG. 2A shows view 200 of the installed anchored base 130. Anchored base 130 can include anchor plate 110, anchoring system 134, and anchor bolts 136 and 138. As an illustrative example, anchored base 130 can be installed onto a surface 140 by anchor bolts 136 and 138 and/or a hardening material, such as concrete. A power source (not pictured) can extend through opening 144 of anchoring system 134 to operatively connect and/or supply power to, for example, LED optical chamber 146 (not pictured). According to the embodiments herein, once anchored base 130 is secured onto surface 140, bollard 108 can be slideably mated with anchored base 130, as shown in view 210 of FIG. 2B. In this way, the bottom end 112 of bollard 108 can slide onto anchoring system 134 while stabilized by way of anchor plate 110. Anchoring system 134 can further include first extrusion 106 and can mate with bollard 108, before subsequently being secured in place via one or more locking screws 142 inserted into counterbore 148, as shown in view 220 of FIG. 2C.

Figure 3A:
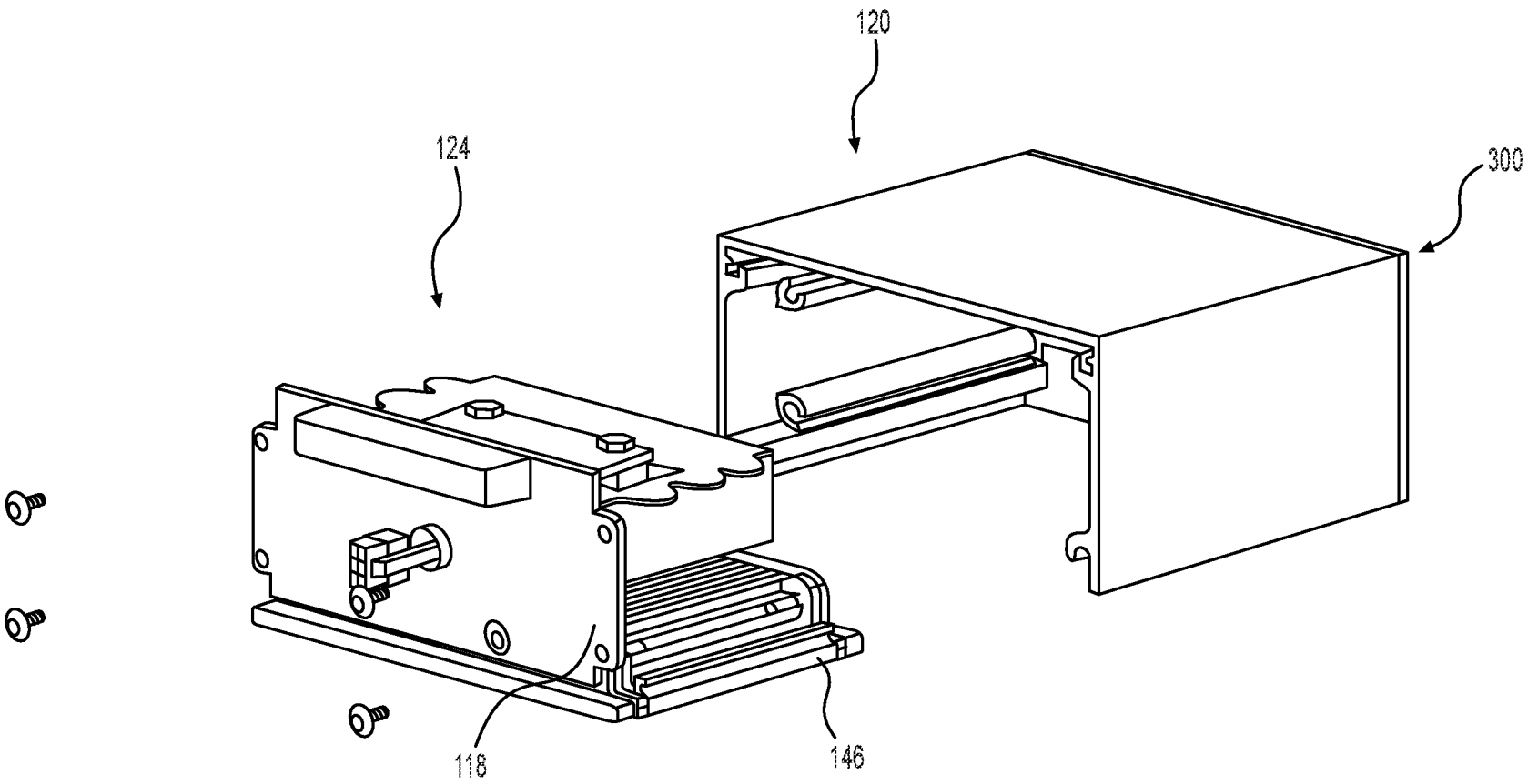
FIG. 3A is an exploded view of the fixture head and the front cap.
Figure 3B:
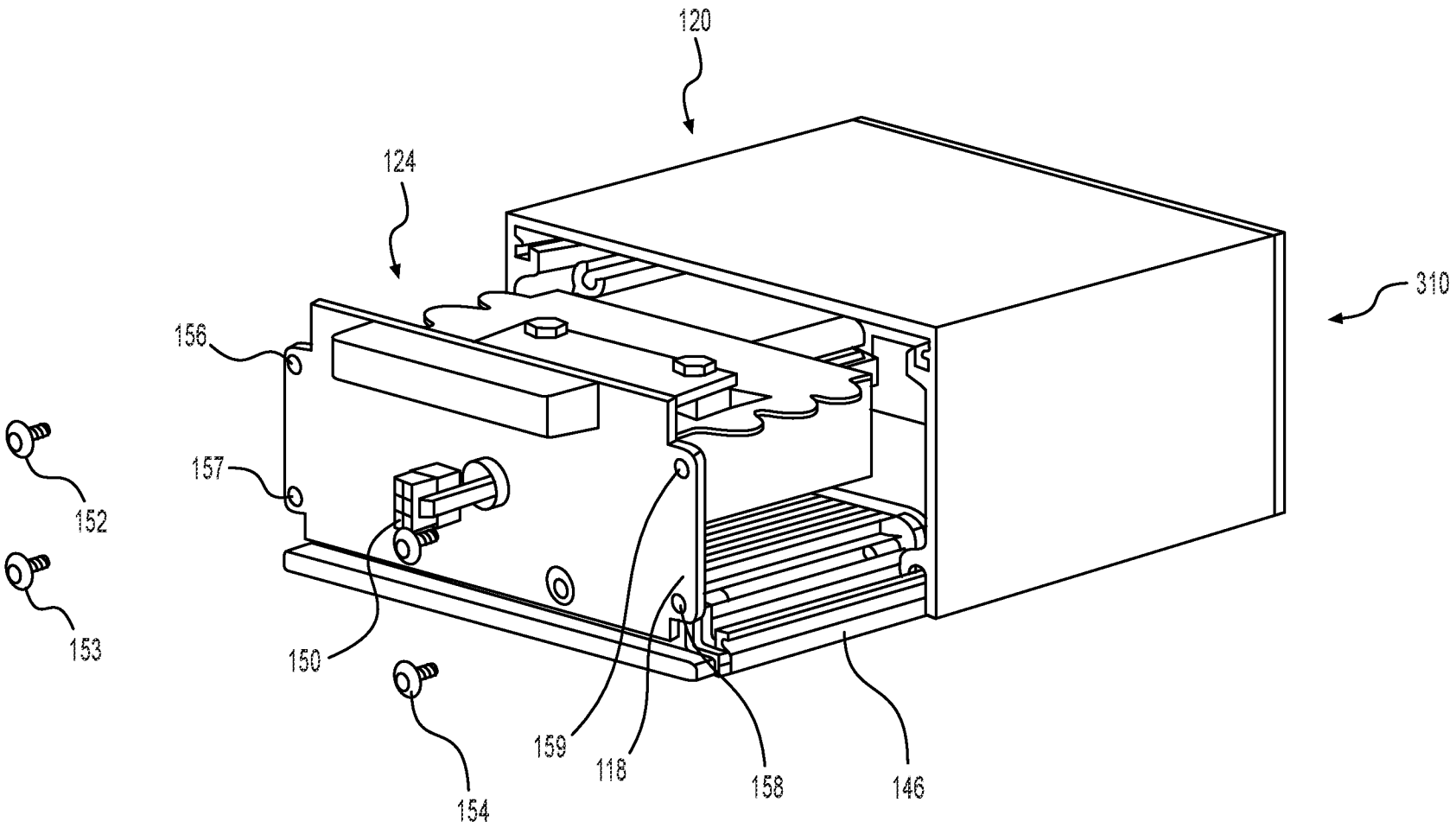
FIG. 3B is an additional exploded view of the fixture head and front cap, highlighting the four points of contact within the front cap which can mate with the third extrusion within the fixture head.
Figure 3C:
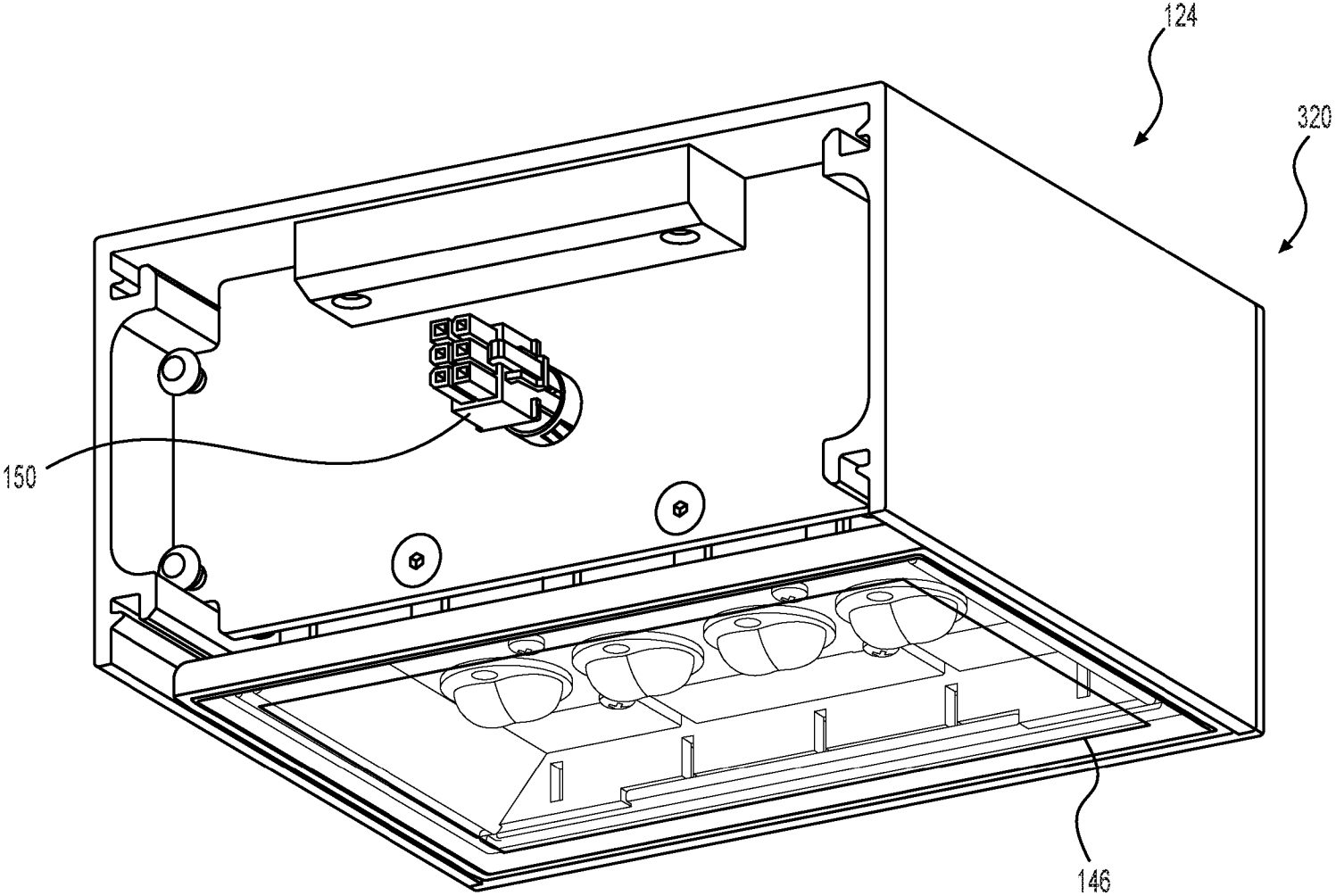
FIG. 3C is a perspective view of the assembled fixture head, highlighting the LED optical chamber.

FIG. 3A shows an exploded view 300 of the fixture head 124 and the front cap 120. Fixture head 124 includes a third extrusion 118, which can mate with front cap 120 at four points of contact, as shown in view 310 of FIG. 3B. Fixture head 124 also includes LED optical chamber 146, disposed on its underside, which can slideably be inserted alongside fixture 124 to subsequently be exposed on the underside of front cap 120. Additionally, once fixture head 124 is slideably inserted into front cap 120, fixture head 124 can be secured to front cap 120 via one or more locking screws 152, 153, 154, and 155 inserted into counterbores 156, 157, 158, and 159, as shown in FIG. 3B. This allows for one or more locking screws 152, 153, 154, and 155 to remain hidden from view when lighting apparatus 102 is assembled, allowing for a flusher exterior appearance. FIG. 3C shows perspective view 320 of the assembled fixture head 124 after mating with front cap 120, highlighting LED optical chamber 146. Once fixture head 124 is secured to bollard 108, cable 150 allows for LED optical chamber 146 to operatively connect with a power source. According to some embodiments, mated fixture head 124 is further configured to mate with fourth extrusion 122 at four points of contact to join fixture head 124 to bollard 108 and operatively connect LED optical chamber 146 by way of cable 150, which extends, for example, through anchored base 126 to a power source.

Figure 4A:
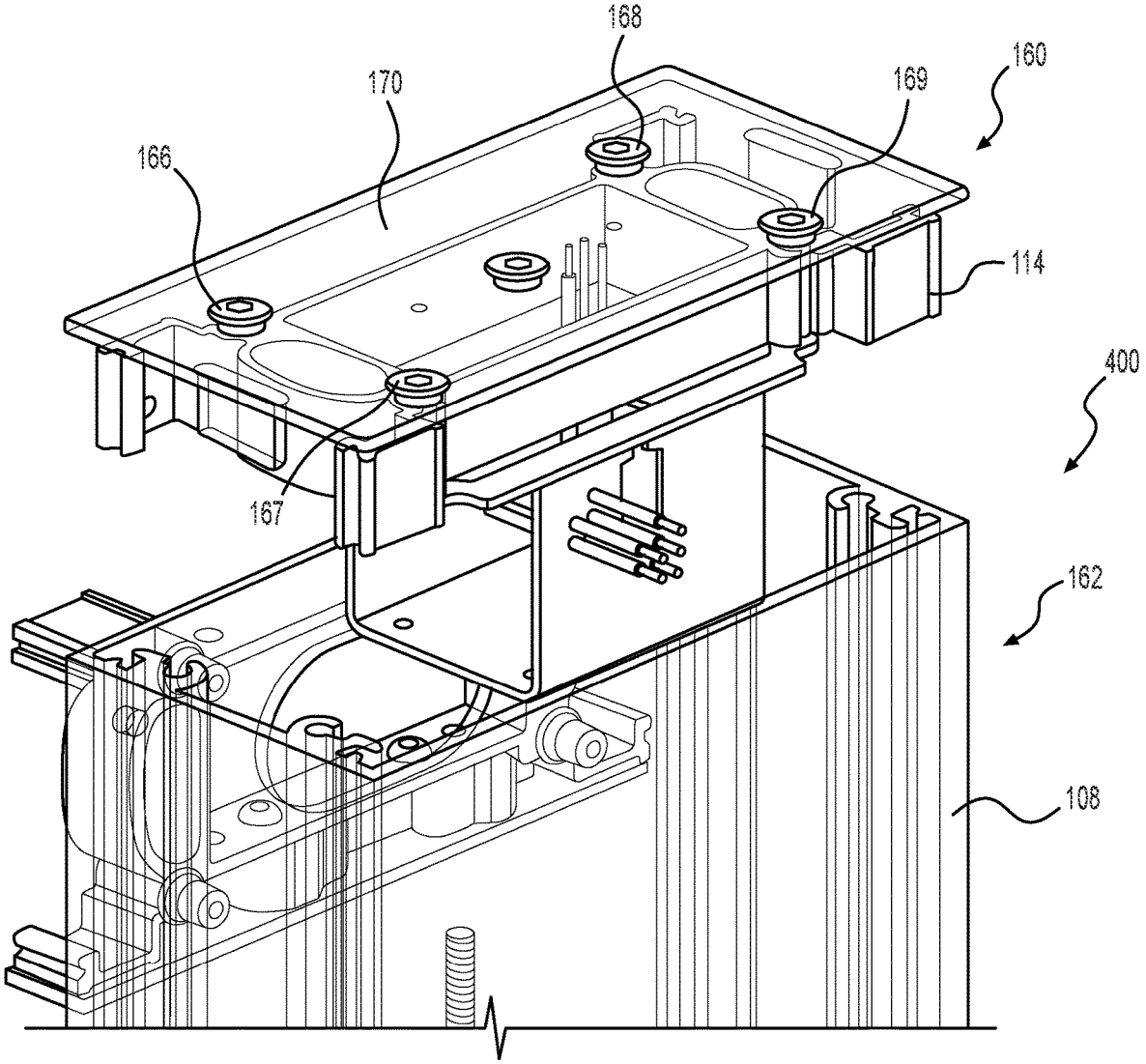
FIG. 4A is an exploded view of the cap attachment, including the second extrusion configured to mate with the bollard at a top end of the bollard at four points of contact.

FIG. 4A shows view 400 of cap attachment 160, including the second extrusion 114 and top cap 164, which can be secured to second extrusion 114 via one or more screws 166, 167, 168, and 169. Subsequently, one or more screws 166, 167, 168, and 169 can be visually obscured by head cover 170. According to some embodiments, second extrusion 114, like each of the other disclosed extrusions, is configured to mate at four points of contact with the bollard 108 at a top end 162 of the bollard 108. Additionally, cap attachment 160 is configured to operatively connect the fixture head 124 with the anchored base 126 to, for example, provide power to LED optical chamber 146 from a power source. According to some embodiments, LED optical chamber 146 is operatively connected to a drive assembly (not pictured). According to some embodiments, the drive assembly is operatively connected to a main body assembly (not pictured) disposed within the bollard 108 and in communication with LED optical chamber 146.

Figure 4B:
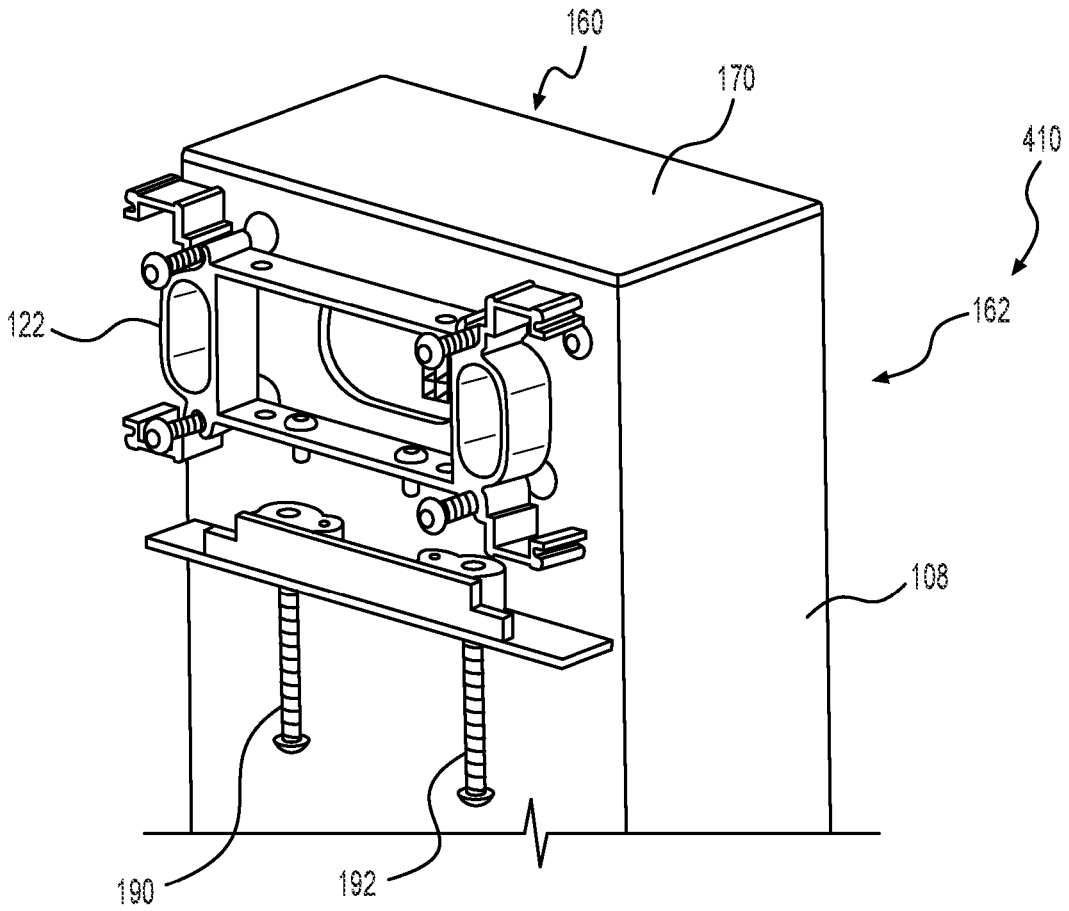
FIG. 4B is a perspective view of the assembled cap attachment, including the fourth extrusion configured to mate with the fixture head.
Figure 5A:
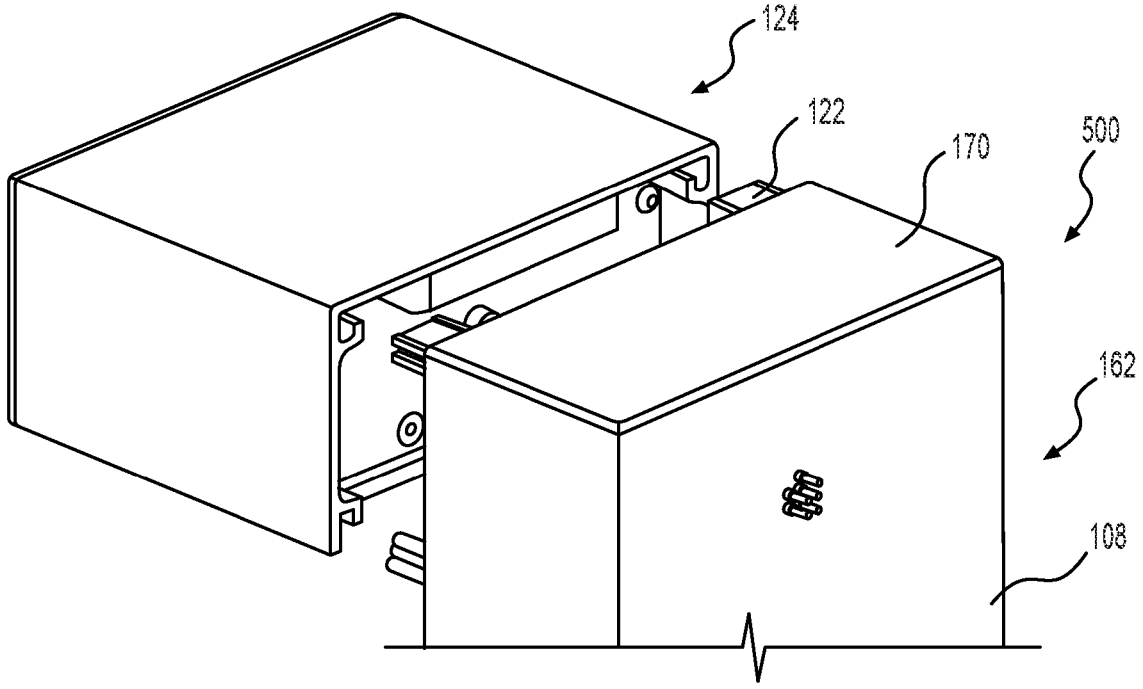
FIG. 5A is a perspective view of the fixture head mating with the fourth extrusion to join with the top end of the bollard.
Figure 5B:
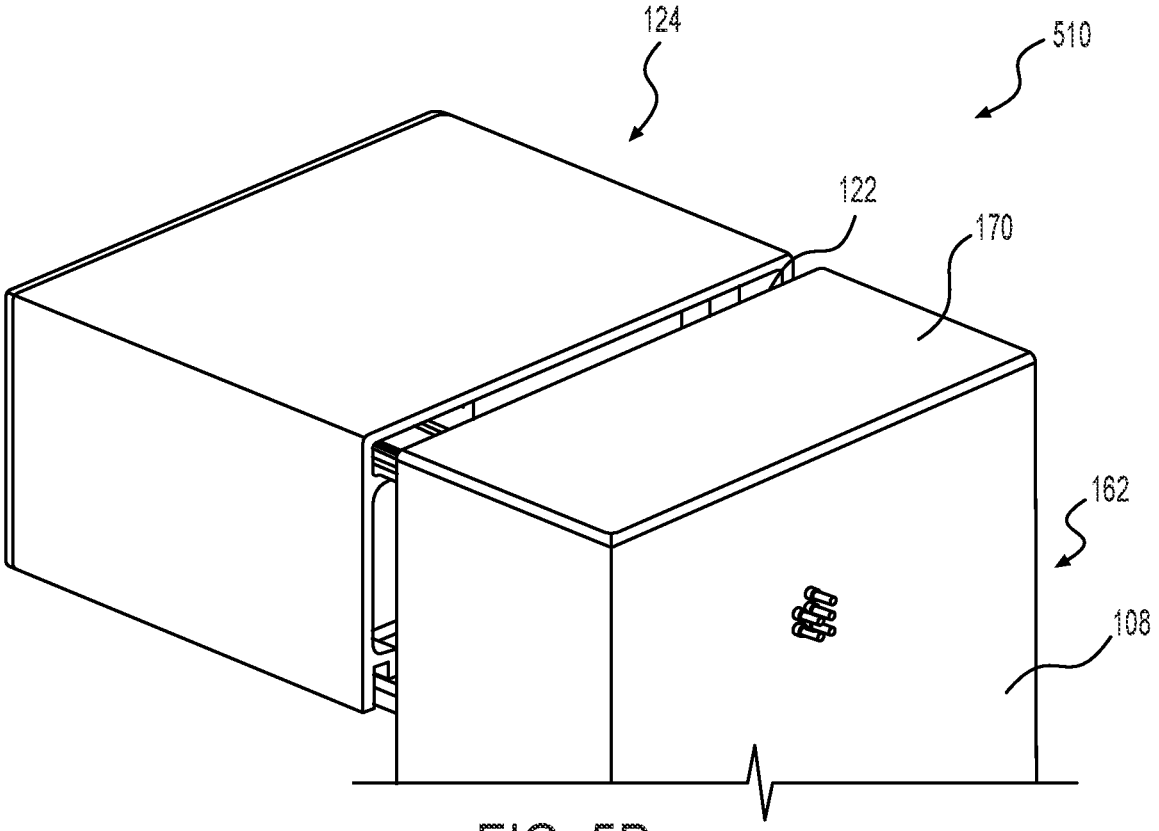
FIG. 5B is an additional view of the fixture head mating with the fourth extrusion to join with the top end of the bollard.
Figure 5C:
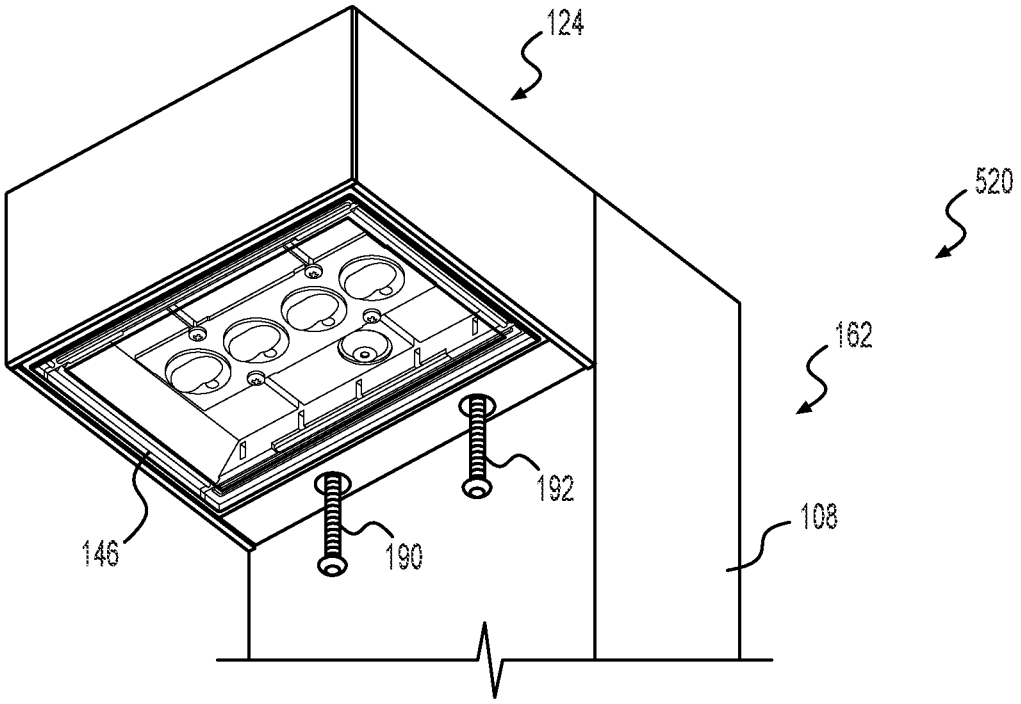
FIG. 5C is a bottom-up view of the lighting apparatus following the mating of FIGS. 5A-5B.
Figure 5D:
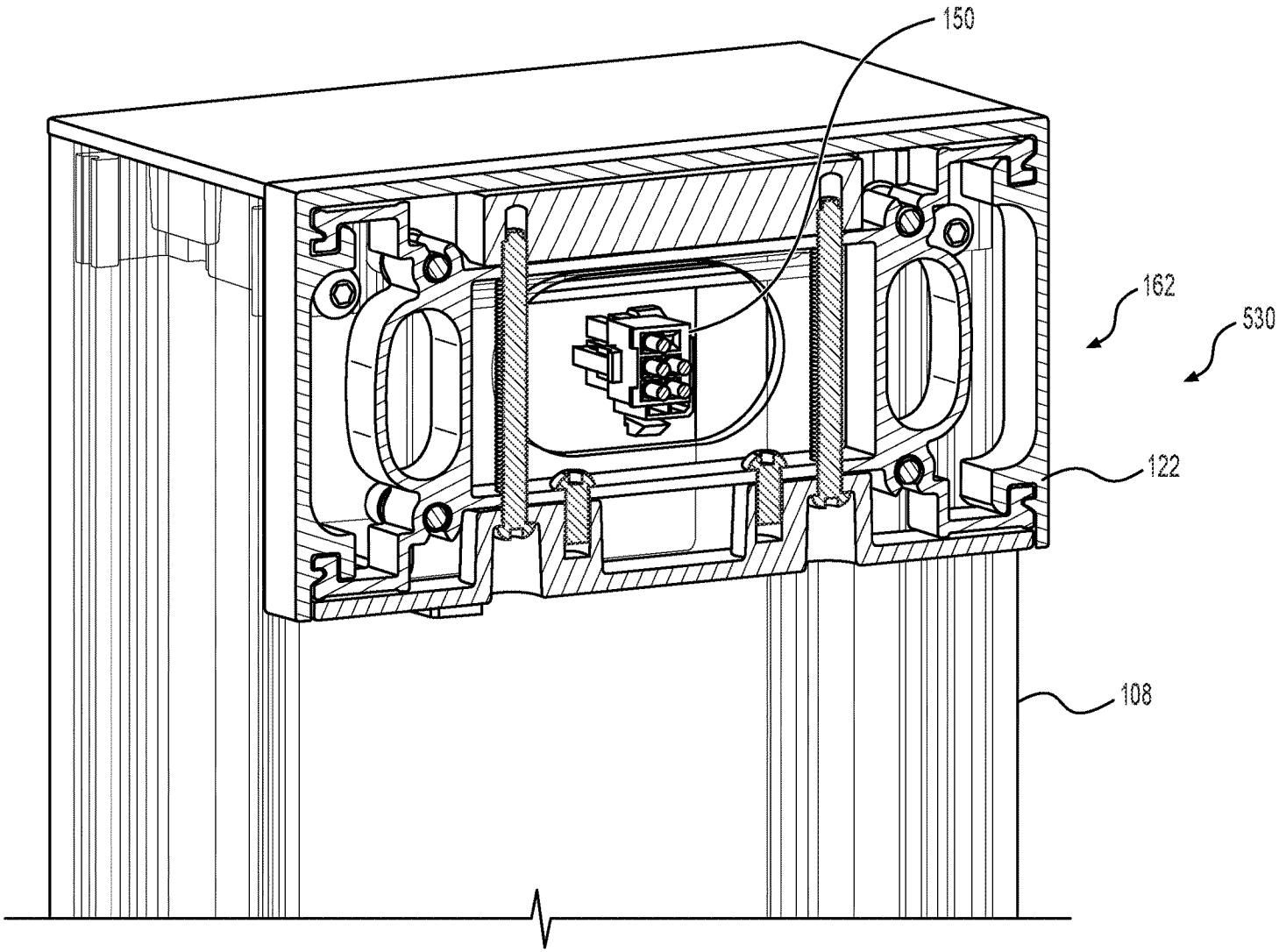
FIG. 5D is a perspective view of the operative connection between the bollard, fourth extrusion, and fixture head in order to provide power to the LED optical chamber.

FIG. 4B show a perspective view 410 of the assembled cap attachment 160, including the fourth extrusion 122, which, according to some embodiments of the present disclosure, is configured to mate with the fixture head 124 at four points of contact. Fourth extrusion 122 can be affixed to top end 162 of the bollard 108 by one or more screws, as shown in FIG. 4B. Further, according to the embodiments of the present disclosure, once assembled fixture head 124 is mated to the top end 162 of bollard 108 via fourth extrusion 122, as shown in FIGS. 5A and 5B at views 500 and 510 respectively, LED optical chamber 146 is secured to the fourth extrusion 122 by screws 190 and 192, as shown in view 520 of FIG. 5C. According to some embodiments, one or more screws are visually obscured by one or more counterboles, also shown view 520 of FIG. 5C. In this way, fixture head 124 can be secured to top end 162 of bollard 108 via fourth extrusion 122. Additionally, FIG. 5D shows a perspective view 530 of the operative connection provided by cable 150 running through from, for example, a power source, anchored base 126, a drive assembly, a main body assembly, bollard 108, fourth extrusion 122, and fixture head 124 in order to provide power to the LED optical chamber 146.

Figure 6:
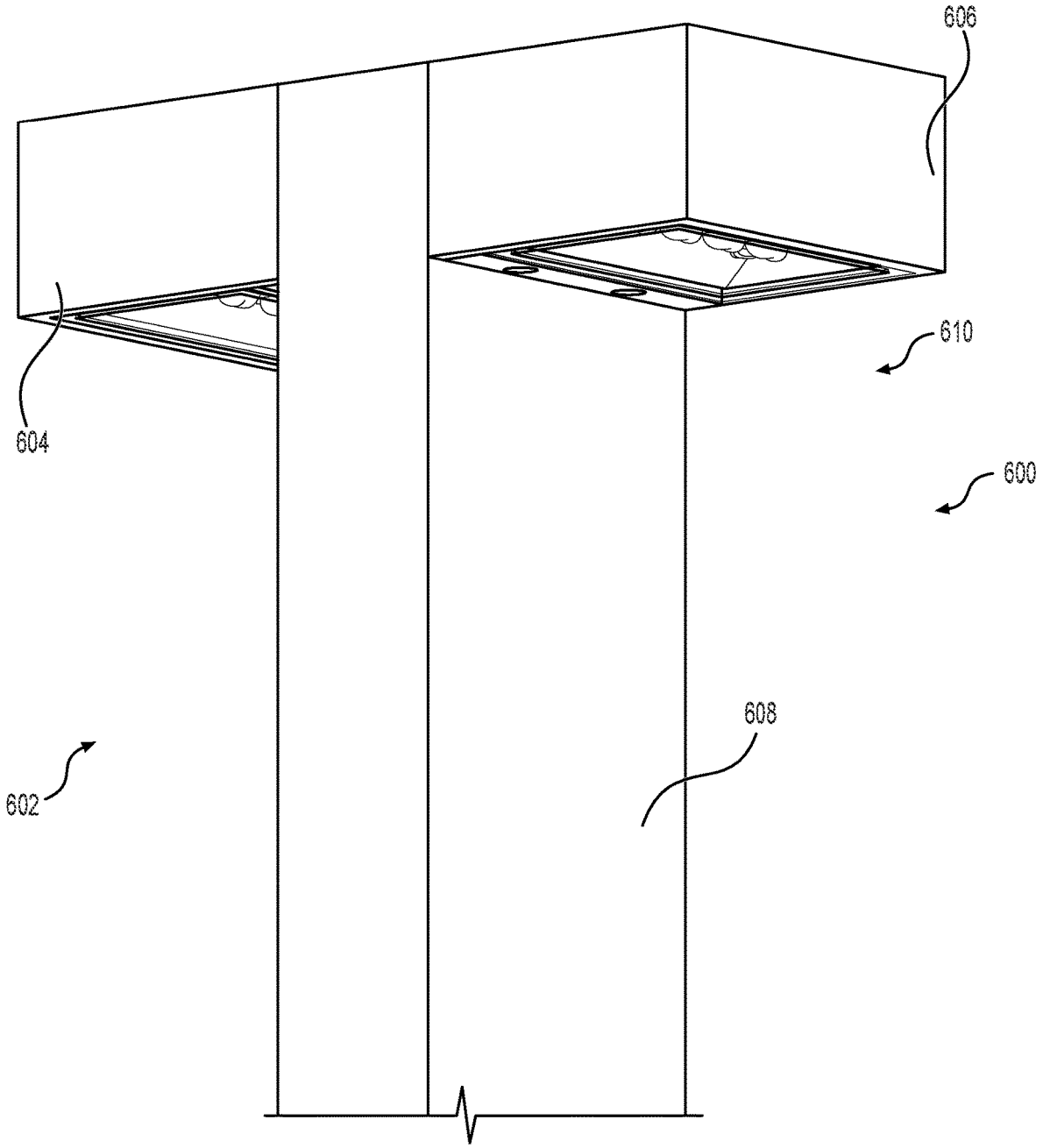
FIG. 6 is a perspective view of a lighting apparatus with two fixture heads.

According to the embodiments of the present disclosure, a lighting apparatus can also include a first fixture head attachment 604 and a second fixture head attachment 606, as shown in view 600 of lighting apparatus 602 in FIG. 6. As an illustrative example, lighting apparatus 602 can be otherwise identical to lighting apparatus 102 but can further include second fixture head attachment 606 disposed on an exterior surface of the bollard 608 at a top end 610 and distally from the first fixture head 604. To join with the bollard 608 at a top end, second fixture head attachment 606 can include a fifth extrusion 612 (not pictured), which is configured to mate at, for example, four points of contact with the fixture head 606 and operatively connect the fixture head 606 with anchored base 614 (not pictured) in a similar fashion to lighting apparatus 102. Additionally, in the same way as lighting apparatus 102, the mating of each of the extrusions in lighting apparatus 602 allows for lighting apparatus 602 to more flushly visually obscure one or more screws. Further, as with lighting apparatus 102, the one or more screws in lighting apparatus 602 can be held in position by one or more non-loadbearing counterboles.

Figure 7:
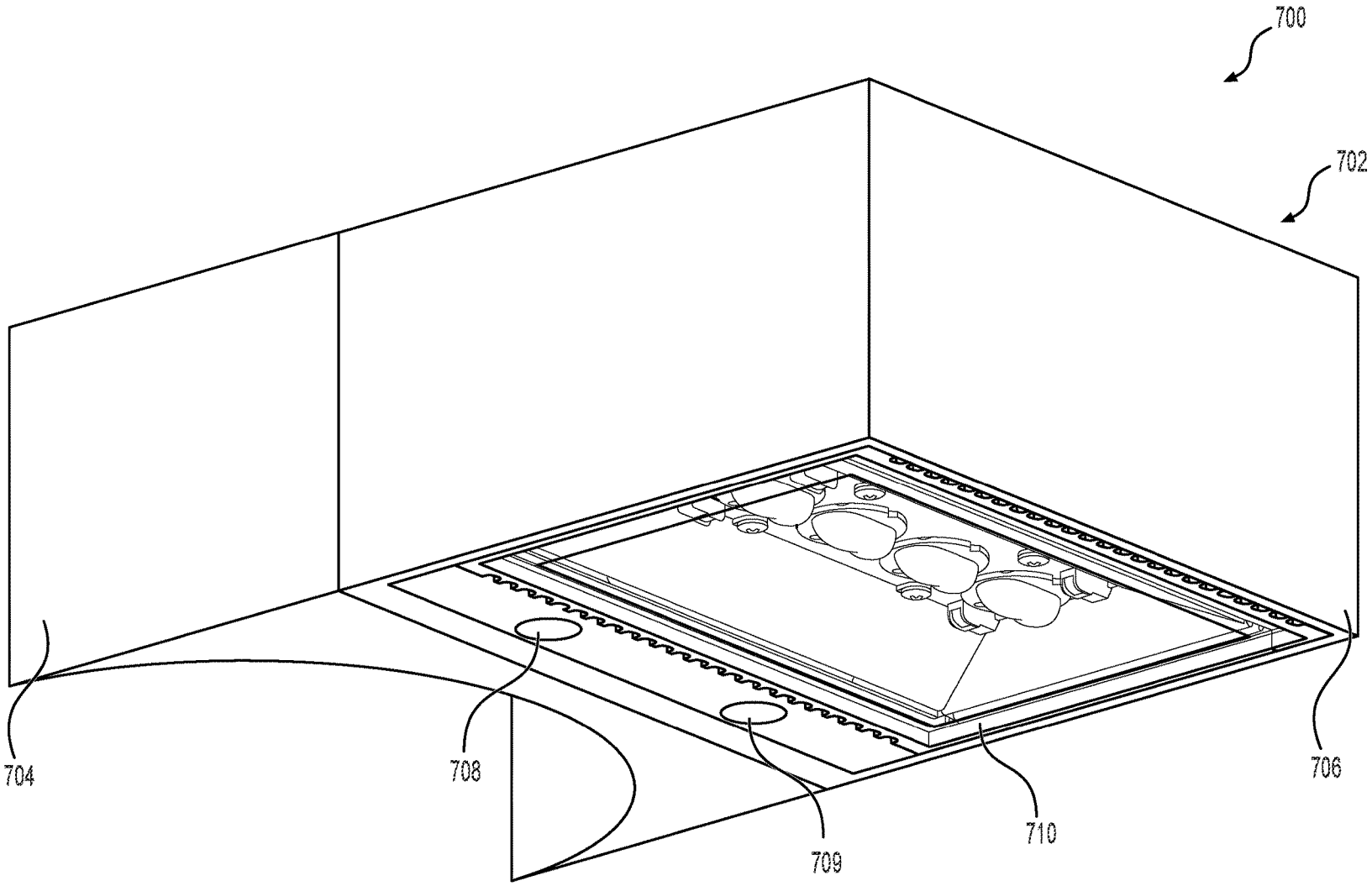
FIG. 7 is a perspective view of a lighting apparatus that can be joined with an alternate bollard structure.

According to the embodiments of the present disclosure, a lighting apparatus can also include an alternate bollard structure, as shown in view 700 of FIG. 7. For example, lighting apparatus 702 can contain a single extrusion (not pictured), which allows for adapter 704 to mate with fixture head 706, and is otherwise alike to fixture heads 124, 604, and 606 in operatively connecting LED optical chamber 710. Adapter 704 can thereby be mounted on, for example, a pole (not pictured) to provide flexibility in where and how it is utilized, while still flushly visually obscuring one or more screws and held in position by one or more non-loadbearing counterboles at 708 and 709.

Figure 8A:
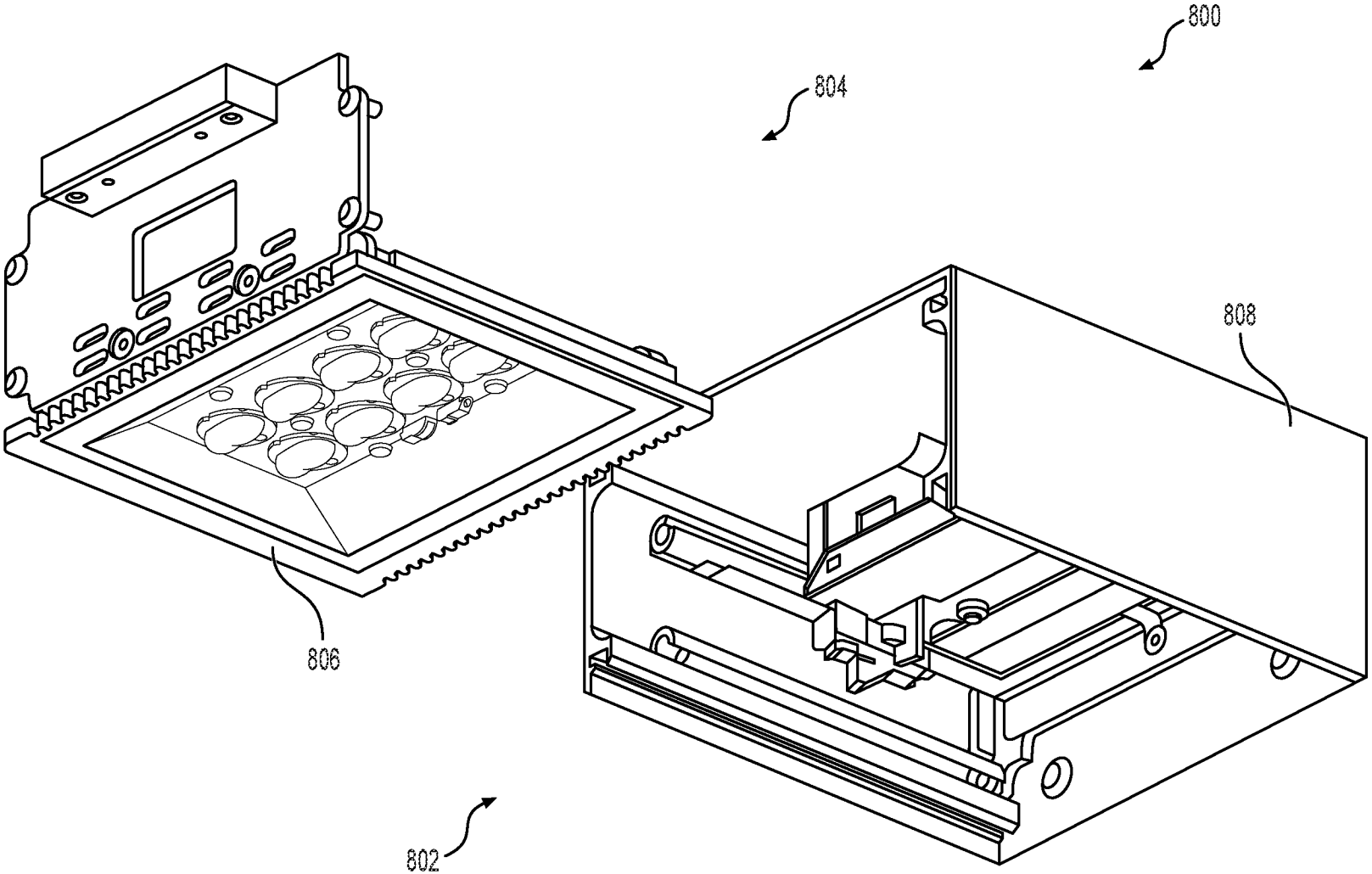
FIG. 8A is an exploded view of a lighting apparatus with an alternate LED optical chamber.
Figure 8B:
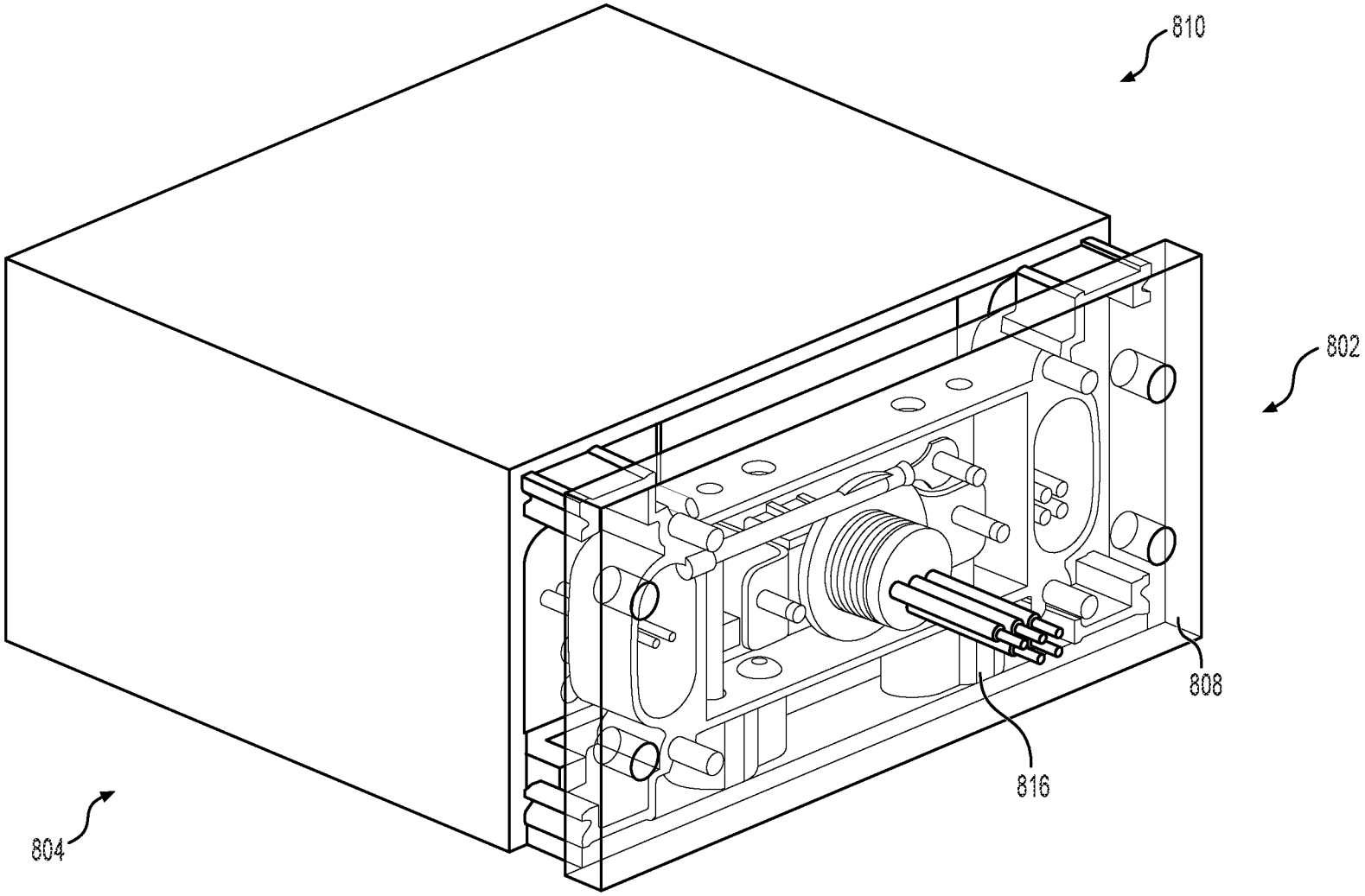
FIG. 8B is a perspective view of the assembled alternate LED optical chamber.
Figure 8C:
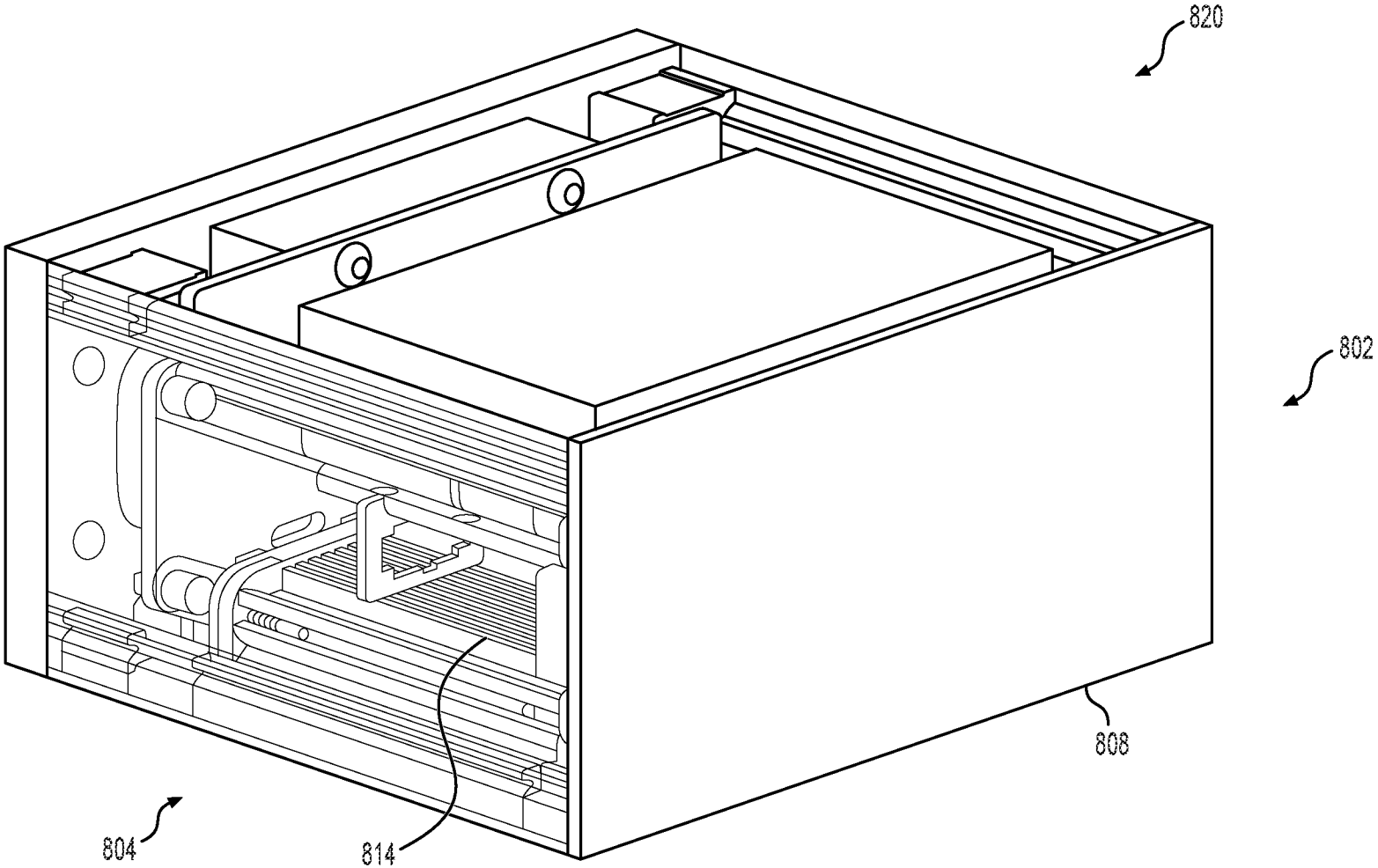
FIG. 8C is another perspective view of the assembled alternate LED optical chamber, highlighting the heatsink extrusion and mated four points of contact within the optical chamber.

Additionally, according to the embodiments of the present disclosure, a lighting apparatus 802 can also include an alternate LED optical chamber 804, and shown in view 800 in FIG. 8A. Alternate LED optical chamber 804 can include an LED board 806 with 8 bulbs instead of an LED board with 4 bulbs, as is present in lighting apparatus 102. As an illustrative example, lighting apparatus 802 can be otherwise identical to lighting apparatus 102. Lighting apparatus 802 is configured to mate at, for example, four points of contact with the fixture head 808 and operatively connect the fixture head 808 with anchored base 812 (not pictured) via one or more cables 816 and in a similar fashion to lighting apparatus 102 and as seen in view 810 of FIG. 8B. In view 820 of FIG. 8C, lighting apparatus 802 can also be seen in a mated configuration, including LED optical chamber heatsink 814, which is disposed above LED board 806 in the illustrative embodiment. In some embodiments, fixture head 808 and LED optical chamber heatsink 814 are one inch longer to accommodate LED board 806. Additionally, in the same way as lighting apparatus 102, the mating of each of the extrusions in lighting apparatus 802 allows for lighting apparatus 802 to more flushly visually obscure one or more screws. Further, as with lighting apparatus 102, the one or more screws in lighting apparatus 802 can be held in position by one or more non-loadbearing counterboles.

Figure 9:
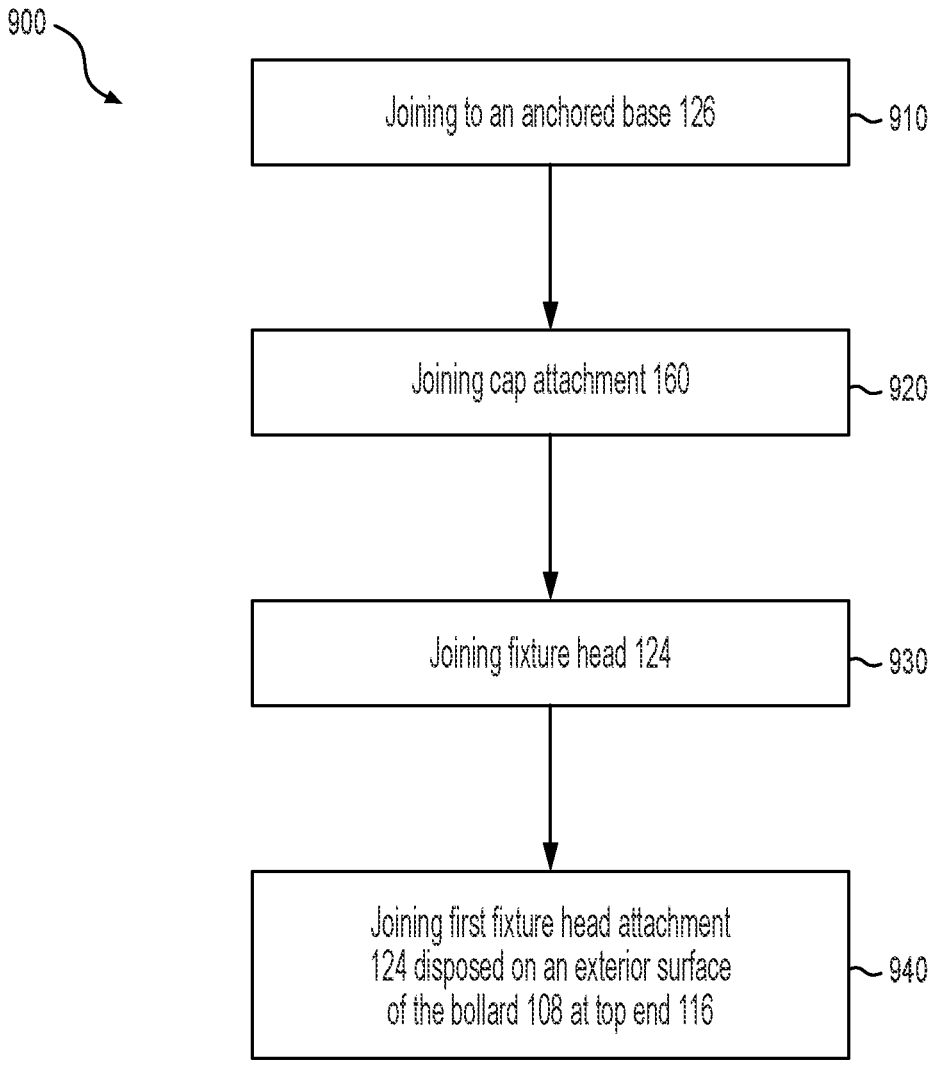
FIG. 9 is an exemplary process for mating a slide attachment.

FIG. 9 is an exemplary process 900 for mating a slide attachment including: joining to anchored base 126 (Step 910). The anchored base 126 includes bollard 108 configured to slide onto anchor plate 110 and first extrusion 106 configured to mate the bollard 108 with the anchor plate 110 at bottom end 112. Process 900 may further include joining cap attachment 160 (Step 920). The cap attachment 160 includes second extrusion 114 configured to mate with the bollard 108 at top end 116. Process 900 may further include joining fixture head 124 (Step 930). The fixture head 124 includes third extrusion 118 disposed on LED optical chamber 146 and front cap 120, wherein third extrusion 118 is configured to mate with front cap 120. Process 900 may also include joining first fixture head attachment 124 disposed on an exterior surface of the bollard 108 at top end 116 (Step 940). The first fixture head attachment 124 includes fourth extrusion 122 configured to mate with the fixture head 124 and operatively connect the fixture head 124 with the anchored base 126. Additionally, the first, second, third, and fourth extrusions 106, 114, 118, and 122 respectively can be configured to respectively mate at four points of contact to flushly obscure one or more screws.

Whereas many alterations and modifications of the disclosure will become apparent to a person of ordinary skill in the art after having read the foregoing description, it is to be understood that the particular embodiments shown and described by way of illustration are in no way intended to be considered limiting. Further, the subject matter has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

The invention claimed is:

1. A lighting apparatus comprising:

an anchored base comprising a bollard configured to slide onto an anchor plate and a first extrusion configured to mate the bollard with the anchor plate at a bottom end of the bollard;

a cap attachment comprising a second extrusion configured to mate with the bollard at a top end of the bollard;

a fixture head comprising a third extrusion disposed on an LED optical chamber and a front cap, wherein the third extrusion is configured to mate with the front cap; and a first fixture head attachment disposed on an exterior surface of the bollard at a top end, wherein the first fixture head attachment includes a fourth extrusion configured to mate with the fixture head and operatively connect the fixture head with the anchored base, wherein the first, second, third, and fourth extrusions are configured to respectively mate at four regions of contact to flushly visually obscure one or more screws.

2. The apparatus of claim 1, wherein the anchor plate further comprises an anchoring system and an anchor bolt.

3. The apparatus of claim 1, wherein the bollard is secured to the anchor plate with one or more locking screws.

4. The apparatus of claim 1, wherein a locking screw secures the anchored base to a counterbore in the bollard.

5. The apparatus of claim 1, wherein the first extrusion can be configured to link the anchored base more strongly to the bollard.

6. The apparatus of claim 1, wherein the cap attachment is configured to operatively connect the fixture head with the anchored base.

7. The apparatus of claim 1, wherein the cap attachment is secured by one or more screws.

8. The apparatus of claim 7, wherein the one or more screws are visually obscured by a head cover.

9. The apparatus of claim 1, wherein the LED optical chamber is secured to the fourth extrusion by one or more screws.

10. The apparatus of claim 9, wherein the one or more screws are visually obscured by the front cap.

11. The apparatus of claim 1, wherein the LED optical chamber is operatively connected to a drive assembly.

12. The apparatus of claim 11, wherein the drive assembly is operatively connected to a main body assembly disposed within the bollard.

13. The apparatus of claim 1, wherein the first fixture head attachment is secured to the fourth extrusion by one or more screws.

14. The apparatus of claim 13, wherein the one or more screws are visually obscured by one or more counterboles.

15. The apparatus of claim 13, wherein the one or more screws is secured by one or more counterboles.

16. The apparatus of claim 1, further comprising a second fixture head attachment disposed on an exterior surface of the bollard at a top end and distally from the first fixture head attachment.

17. The apparatus of claim 16, wherein the second fixture head attachment includes a fifth extrusion configured to mate with the fixture head and operatively connect the fixture head with the anchored base.

18. The apparatus of claim 17, wherein the first, second, third, fourth, and fifth extrusions are configured to respectively mate at four points of contact to flushly visually obscure one or more screws.

19. The apparatus of claim 1, wherein the one or more screws are held in position by one or more non-loadbearing counterboles.

20. A method of mating a slide attachment comprising:

joining to an anchored base, wherein the anchored base includes a bollard configured to slide onto an anchor plate and a first extrusion configured to mate the bollard with the anchor plate at a bottom end;

joining a cap attachment, wherein the cap attachment includes a second extrusion configured to mate with the bollard at a top end;

joining a fixture head, wherein the fixture head includes a third extrusion disposed on an LED optical chamber and a front cap, wherein the third extrusion is configured to mate with the front cap; and joining a first fixture head attachment disposed on an exterior surface of the bollard at a top end, wherein the first fixture head attachment includes a fourth extrusion configured to mate with the fixture head and operatively connect the fixture head with the anchored base, wherein the first, second, third, and fourth extrusions are configured to respectively mate at four points of contact to flushly obscure one or more screws.

* * * * *